United States Patent [19]

Diessel et al.

[11] B 4,006,093

[45] Feb. 1, 1977

[54] SURFACTANTS CONTAINING IODINE

[75] Inventors: Paul Diessel, Mannheim, Germany; Herbert Helfert, Trenton, Mich.; Reiner Hamm, Ludwigshafen; Hans-Georg Scharpenberg, Limburgerhof, both of Germany

[73] Assignee: BASF Aktiengesellschaft, Ludwigshafen (Rhine), Germany

[22] Filed: Dec. 6, 1974

[21] Appl. No.: 530,303

[44] Published under the second Trial Voluntary Protest Program on March 23, 1976 as document No. B 530,303.

[30] Foreign Application Priority Data

Dec. 17, 1973 Germany ..... 2362580

[52] U.S. Cl. ..... 252/106; 260/309.6; 424/150; 424/275

[51] Int. Cl.[2] ..... C11D 3/48

[58] Field of Search ..... 252/106, 107, 544; 424/150, 275; 260/309.6

[56] References Cited

UNITED STATES PATENTS

| | | | |
|---|---|---|---|
| 2,211,001 | 8/1940 | Chwala | 260/309.6 |
| 2,262,743 | 11/1941 | De Groote et al. | 252/344 |
| 2,977,315 | 3/1961 | Scheib et al. | 252/106 |
| 3,028,427 | 4/1962 | Winicov | 260/567.6 |
| 3,438,906 | 4/1969 | Duvall | 252/106 |
| 3,438,907 | 4/1969 | Schmolka | 252/106 |
| 3,534,102 | 10/1970 | Waldstein | 260/584 |
| 3,567,734 | 3/1971 | Johnson | 260/309.6 |

FOREIGN PATENTS OR APPLICATIONS

| | | |
|---|---|---|
| 526,585 | 3/1954 | Belgium |
| 799,721 | 8/1958 | United Kingdom |

*Primary Examiner*—P.E. Willis, Jr.
*Attorney, Agent, or Firm*—Johnston, Keil, Thompson & Shurtleff

[57] ABSTRACT

Detergent-iodine complexes consisting of oxyalkylation products of fatty alkyl-imidazolines which have been reacted with iodine.

4 Claims, No Drawings

SURFACTANTS CONTAINING IODINE

The invention relates to special non-ionic surfactants containing iodine, which have a disinfectant and cleansing action and are very low-foaming.

Though the previously used non-ionic detergents containing iodine (referred to as iodophores) were entirely satisfactory with regard to cleansing action and disinfectant power, their tendency to foam stood in the way of their optimum utilization for many applications. The patent literature which describes such detergents is extensive and discloses, above all, block copolymers of ethylene oxide and propylene oxide, as explained, for example, in U.S. Pat. No. 2,977,315, which can optionally be used in admixture with other compounds containing active hydrogen, as disclosed, for example, in U.S. Pat. No. 3,285,816. Other known types are alkylphenol-oxyethylates and other oxyethylated compounds, in most cases containing alcoholic hydroxyl groups, the compounds containing a greater or lesser amount of iodine, bound as a complex.

It is an object of the invention to provide iodophores which in addition to having the above advantageous cleansing and disinfectant properties are also low-foaming.

We have found that this object is achieved, surprisingly, with oxyalkylated compounds of a very specific structure, which contain active hydrogen.

The detergent-iodine addition complexes, which yield a germicidally active amount of iodine and in which the detergent component of the complex is a product of the addition reaction of alkylene oxides with compounds containing active hydrogen, contain, as the detergent component, at least one compound of the formula

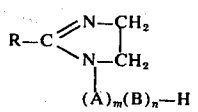

in which R is alkyl or alkenyl of 2 to 22 carbon atoms, A is an ethylene oxide radical, B is a propylene oxide radical, $m$ is an integer from 10 to 30 and $n$ is an integer from 3 to 10, and the ratio $n:m$ is 1: (from 2 to 8), and contain from 15 to 40% by weight, based on the detergent component, of iodine bound as a complex.

The non-ionic component is simple to manufacture in accordance with the teaching of numerous prior patents. For example, according to U.S. Pat. No. 2,267,365 the basic compound prior to oxyalkylation, namely the alkylimidazoline or alkenylimidazoline, can be obtained by reacting higher saturated or unsaturated fatty acids of 2 to 22 carbon atoms or their functional derivatives, such as esters or acid chlorides, with n-$\beta$-hydroxyethyl-ethylenediamine at elevated temperatures; this first results in the formation of the acid amide, which is then converted to the imidazoline by cyclization and elimination of water. The said imidazolines can be obtained in even greater purity by adding a complex boron hydride as the catalyst to the reaction mixture, as taught, for example, by U.S. Pat No. 3,468,904.

All saturated and unsaturated carboxylic acids which contain from 2 to 22, or from 3 to 22, carbon atoms in the alkyl or alkenyl radical, respectively, can be used as fatty acids for the manufacture of the basic component.

Examples are butyric acid, 2-ethyl-hexanoic acid, palmitic acid, stearic acid, coconut fatty acid, palm kernel fatty acid, oleic acid, ricinoleic acid, linoleic acid, linolenic acid, linseed oil fatty acid, fish oil fatty acid, cottonseed oil fatty acid, groundnut oil fatty acid, erucic acid, myristic acid and their mixtures. For the purposes of the invention, linoleic acid, oleic acid and stearic acid are particularly preferred. Mixtures of the said fatty acids such as occur, for example, in nature and are derived, for example, from tallow, palm kernel oil, soy oil or castor oil, are also very suitable.

In accordance with the teaching of the above publications, the hydroxyethyl-ethylenediamine may be reacted with the fatty acids at elevated temperatures and the products converted to the imidazoline by subsequent heating to even higher temperatures up to and above 190°C, optionally with acid catalysis.

The oxyethylation and subsequent oxypropylation may be carried out in accordance with conventional methods, for example by base-catalyzed reaction at from 100° to 150°C; preferably, the oxyethylation is carried out at somewhat lower temperatures, from 110°C to 120°C, and the subsequent oxypropylation at higher temperatures, such as from 130° to 140°C.

From 10 to 30 moles of ethylene oxide are used per mole of imidazoline, followed by from 3 to 10 moles of propylene oxide, based on 1 mole of imidazoline derivative. Within the limits of the ratios mentioned, the ratio of propylene oxide to ethylene oxide ($n:m$) must be from 1:2 to 1:8, preferably from 1:3 to 1:4, if the end product is to have optimum low-foaming properties.

The oxyalkylated product is then reacted with from 15 to 40% by weight of elementary iodine, based on the oxyalkylated product. Some of this iodine is lost by chemical addition to the imidazoline base material. This proportion of the iodine is held so firmly in the form of a complex that it can no longer be titrated and therefore no longer has a disinfectant action. The reaction can also be carried out in aqueous solution by briefly warming the solution which contains the oxyalkylated imidazoline and the iodine. In that case, however, the free iodine content of the end product is less.

It is also possible to add hydriodic acid to the oxyalkylated product and then add a sufficient amount of hydrogen peroxide; this again gives the product of the invention, though with an even greater loss of titratable iodine. The reaction with iodine is normally carried out at temperatures from 50° to 70°C.

The compounds obtained (which are mixtures of addition complexes and penetration complexes) are substances which give a clear solution in water and have particularly little tendency to foam. As a result, these iodine complexes are universally applicable. They can be used, optionally in conjunction with other, conventional surfactants and detergents, for cleaning bottles in the beverage industry, for example in breweries, in agriculture (for example for cleaning milking machines), for washing eggs, for disinfecting animal stalls, and in abattoirs. They can also be used in hospitals (for disinfecting floors, beds, baths, instruments etc.), in restaurants and elsewhere, for example in toilets, where, in addition to the cleansing required, disinfection of the cleansed items must be given increased attention.

The compounds act as disinfectants against a broad range of bacteria, for example Staphylococcus, Aerobacter, Proteus, tuberculosis bacilli, Escherichia and Pseudomonas. They are also active against fungi such as Penicillium, Trichoderma, Trichomonads, Aspergillus niger and Oidium.

The various series of tests which follow are intended to show to what extent it was possible to improve the disinfectant action compared to conventional substances. Further series of tests are intended to show that the foam heights given by the use of the compounds of the invention are very low compared to those resulting from the use of conventional substances. The comparison substance used was a nonylphenoloxyethylate containing 10 moles of ethylene oxide, which had been reacted with 20% by weight of iodine.

In all cases it is found that the foam height when using the compounds of the invention is at least 3 times lower than when using the comparison substance.

EXAMPLES

General experimental method ("parts" are parts by weight).

0.5% by weight of sodium methylate or the corresponding amount of KOH is added to 1 mole of 1-hydroxyethyl-2-alkenylimidazoline (prepared according to, for example, U.S. Pat. No. 2,267,365 or U.S. Pat. No. 3,468,904). *m* Moles of ethylene oxide are injected into the mixture in an autoclave at about 120°C and from 3 to 4 atmospheres gauge pressure. A further 0.04% by weight of sodium methylate, based on oxyethylation product, is then added, followed by the injection of *n* moles of propylene oxide at from 130° to 140°C and at approximately 4 atmospheres gauge pressure. 4 parts of the reaction product are then reacted with varying amounts of powdered elementary iodine at 60°C under nitrogen, with vigorous stirring.

The red-brown, fluid, readily water-soluble products containing the amounts of iodine stated in Table 1, which follows, are obtained. The table shows the low-foaming properties.

Table 1

| Ex. | Initial fatty acid | m Moles of EO | n Moles of PO | Foam (DIN 53,902) ml | Iodine employed % by weight | Titratable iodine % by weight | pH Value 10% strength aqueous solution | pH Value 1% strength aqueous solution |
|---|---|---|---|---|---|---|---|---|
| 1 | Oleic acid | 20 | 6 | 10 | 20 | 12.4 | 2.9 | 3.5 |
| 2 | Oleic acid | 30 | 10 | 120 | 20 | 11.9 | 2.2 | 3.2 |
| 3 | Oleic acid | 20 | 6 | 10 | 15 | 7.4 | 2.7 | 3.0 |
| 4 | Oleic acid | 25 | 3 | 30 | 30 | 19.7 | 2.0 | 2.7 |
| 5 | Oleic acid | 25 | 12 | 20 | 30 | 19.8 | 1.9 | 2.6 |
| 6 | Fish oil fatty acid | 20 | 6 | 20 | 20 | 11.8 | 2.3 | 2.9 |
| 7 | Butyric acid | 20 | 6 | 30 | 15 | 5 | 2.8 | 3.2 |
| Comparison | | | | | | | | |
| Nonylphenol | | 10 | — | 250 | 20 | 12 | 2.0 | 2.9 |

RECIPES

The following disinfectant cleansers were prepared with the surfactant-iodine complexes from Examples 1 to 7:

EXAMPLE 8

3% by weight of the complex of Example 1
5% by weight of $C_9$—$C_{11}$—oxo—alcohol + 7 moles of ethylene oxide
3% by weight of phosphoric acid (85% strength)
89% by weight of water
Titratable iodine: approx. 0.6%.

EXAMPLE 9

6% by weight of the complex of Example 3
3% by weight of $C_{13}$—$C_{15}$—oxo—alcohol + 12 moles of ethylene oxide
2% by weight of phosphoric acid (85% strength)
89% by weight of water
Titratable iodine: approx. 1.2%

EXAMPLE 10

7.5% by weight of the complex of Example 5
10% by weight of hydrochloric acid (36% strength)
82.5% by weight of water
Titratable iodine: approx. 1.3%

EXAMPLE 11

10% by weight of the complex of Example 4
5% by weight of $C_9$—$C_{11}$—oxo—alcohol + 8 moles of ethylene oxide
2% by weight of phosphoric acid (85% strength)
83% by weight of water
Titratable iodine: approx. 1.9%

The formulations are good cleansing agents with excellent foaming properties, in the sense of producing little foam. The disinfectant properties are attributable to the (titratable) iodine liberated in acid media.

The Examples which follow illustrate the use, according to the invention, of the active compounds as disinfectants and show their superiority over conventional compounds.

EXAMPLE 12

1 ml of an aqueous solution of an active compound (iodized alkenylimidazoline-oxalkylate according to the Examples shown in Table 2) and 9 ml of a nutrient broth were introduced into a sterile test tube. The nutrient broth was inoculated with germs from a 20 hours old culture of Staphylococcus or Escherichia or Pseudomonas so that $10^6$ germs were present per ml of the mixtures, and the test tubes were incubated for 48 hours at 37°C. After this time, the active compound concentration at which no further growth took place was assessed. As a check, smears were produced on bacterial nutrient media to test when no further growth of the cultures took place. The dilution level at which no further growth took place is recorded as the lethal concentration.

Table 2

| Test organism | Destruction at x ppm of active compound | | | | |
|---|---|---|---|---|---|
| | Iodized heptadecenyl-imidazolineoxyalkylate of Example | | | Iodized nonylphenol + 10 moles of ethylene oxide | Iodine solution as $KI_3$ |
| | 1 | 3 | 3 | | |
| | x | x | x | x | x |
| Escherichia coli | 50 | 100 | 100 | 125 | 120 |
| Pseudomonas fluorescens | 100 | 125 | 125 | 125 | 120 |
| Staphylococcus aureus | 12.5 | 12.5 | 12.5 | 12.5 | 120 |

EXAMPLE 13

1 ml of the particular aqueous solution of active compound and 9 ml of a nutrient broth were introduced into a sterile test tube. The nutrient broth was inoculated with spores from Aspergillus, Oidium and Penicillium cultures so that $10^5$ germs were present per ml of the mixtures, and the test tubes were incubated for 7 days at 20°C. After this time, the active compound concentration at which no further growth took place was assessed. As a check, smears were produced on fungal nutrient media to test whether the cultures continued to grow. The dilution level at which no further growth took place is recorded as the lethal concentration.

Table 3

| Test organism | Destruction at x ppm of active compound | | | | |
|---|---|---|---|---|---|
| | Heptadecenyl-imidazoline-oxalate of Example | | | Nonylphenol + 10 moles of ethylene oxide | Iodine solution as $KI_3$ |
| | 1 | 3 | 7 | | |
| | x | x | x | x | x |
| Aspergillus niger | 25 | 50 | 100 | 125 | 300 |
| Oidium ssp. | 12.5 | 25 | 25 | 50 | 300 |
| Penicillium expansum | 50 | 100 | 100 | 250 | 300 |

We claim:

1. A detergent-iodine addition complex which yields a germicidally active amount of iodine, the detergent component of the complex being at least one compound of the formula

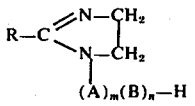

in which R is alkyl or alkenyl of 2 to 22 carbon atoms, A is an ethylene oxide radical, B is a propylene oxide radical, *m* is an integer from 10 to 30 and *n* is an integer from 3 to 10, and the ratio *n:m* is from 1:2 to 1:8, and the amount of iodine bound in said complex being from 15 to 40% by weight, based on the detergent component.

2. A detergent-iodine addition complex as claimed in claim 1, wherein R in the detergent component is the alkyl or alkenyl radical of a fatty acid selected from the group consisting of butyric acid, 2-ethylhexanoic acid, palmitic acid, stearic acid, coconut fatty acid, palm kernel fatty acid, oleic acid, ricinoleic acid, linoleic acid, linolenic acid, linseed oil fatty acid, fish oil fatty acid, cottonseed oil fatty acid, groundnut oil fatty acid, erucic acid, myristic acid and their mixtures, and of mixtures of the fatty acids derived from tallow, palm kernel oil, soy oil and castor oil.

3. A detergent-iodine addition complex as claimed in claim 1, wherein the ratio *n:m* in the detergent component is from 1:3 to 1:4.

4. A detergent-iodine addition complex as claimed in claim 2, wherein the ratio *n:m* in the detergent component is from 1:3 to 1:4.

* * * * *